United States Patent [19]

Morgan et al.

[11] Patent Number: 5,049,846

[45] Date of Patent: Sep. 17, 1991

[54] COMPACT MOLDED CASE CIRCUIT BREAKER WITH INCREASED AMPERE RATING

[75] Inventors: Roger J. Morgan, Simsbury; Irenaeus S. Panus, Forestville; Ronald G. Pekrul, Southington; Thomas F. Papallo, Jr., Plainville; Robert A. Morris, Burlington; Henry J. Tucholski, Terryville; Hamon L. Craft, New Britain, all of Conn.

[73] Assignee: General Electric Company, New York, N.Y.

[21] Appl. No.: 604,538

[22] Filed: Oct. 29, 1990

Related U.S. Application Data

[62] Division of Ser. No. 546,826, Jun. 29, 1990.

[51] Int. Cl.[5] ..... H01H 9/02

[52] U.S. Cl. ..... 335/202; 200/329

[58] Field of Search ..... 335/202, 6; 200/329, 200/331

[56] References Cited

U.S. PATENT DOCUMENTS

| | | | |
|---|---|---|---|
| 3,617,676 | 11/1971 | Dennison | 200/331 |
| 4,115,669 | 9/1978 | Cali | 200/331 |
| 4,151,385 | 4/1979 | Neuser et al. | 200/331 |
| 4,567,337 | 1/1986 | Woods, I et al. | 200/331 |
| 4,794,356 | 12/1988 | Yu et al. | 335/13 |
| 4,804,807 | 2/1989 | Knapp et al. | 200/331 |

*Primary Examiner*—Leo P. Picard
*Assistant Examiner*—Lincoln Donovan
*Attorney, Agent, or Firm*—Richard A. Menelly; Walter C. Bernkopf; Fred Jacob

[57] ABSTRACT

A compact molded case circuit breaker with increased ampere rating employs a latch assembly for maintaining the circuit breaker operating mechanism in a closed condition against a pair of powerful operating springs. To increase the mechanical advantage required to move the operating handle against the springs, a retractable handle extender is attached to the handle. For higher-rated circuit applications, a lug cover extension is added to the line end of the breaker to assist in extinguishing the intense arc that occurs during circuit interruption and to protect the line lugs from inter-phasal circuit faults. A visual access slot is arranged next to the circuit breaker handle to ascertain and verify the condition of the circuit breaker contacts.

4 Claims, 5 Drawing Sheets

COMPACT MOLDED CASE CIRCUIT BREAKER WITH INCREASED AMPERE RATING

This is a Divisional of application Ser. No. 07/546,826, filed June 29, 1990.

BACKGROUND OF THE INVENTION

Industrial-rated circuit breakers are available having operating components that are designed for automatic assembly to provide cost improvement as well as improved operating efficiency. The precision alignment performed by the automated assembly equipment allows the operating components within the circuit breaker operation mechanism to be installed within very close operating tolerances. The operating mechanism assembly includes a pair of powerful operating springs that are overcentered for rapidly driving the movable contact arm and the attached movable contact away from the stationary fixed contact to interrupt the circuit current. The operating mechanism includes a cradle operator which engages a latch assembly to prevent the movable contact arm from being driven to its open position under the urgence of the charged operating springs. The compact latch assembly includes a primary and secondary latch operating within a common support structure.

With higher ampere-rated industrial circuit breaker designs in the range of 1200 ampere continuous current carrying capacity, the correspondingly larger operating springs provide a substantially increased holding force to the circuit breaker contacts such that a correspondingly larger force is required to manually separate the circuit breaker contacts to reset and close the operating mechanism. The increased current transfer through the compact circuit breaker enclosure during overcurrent conditions produces an arc upon contact separation that is difficult to quench and deionize within the close confines of the correspondingly compact arc chamber.

The increased temperature generated within the compact circuit breaker enclosure during circuit interruption heats up several of the current-carrying components such as the movable contact and movable contact arm whereby additional thermal insulating means are required to prevent damage to the lower-temperature materials used within the circuit breaker enclosure.

The increased current creates a correspondingly increased arc that requires additional inter-phasal line lug baffles as well as additional electrical isolation between the electrical and electronic components within the circuit breaker enclosure.

One purpose of the instant invention accordingly is to provide a compact circuit breaker having sufficient capability to allow manual movement of the operating handle to reset and close the circuit breaker against the bias of the operating mechanism springs.

A second purpose of this invention is to provide supplemental arc extinguishing means to the compact circuit breaker enclosure to allow complete and rapid circuit interruption at the higher circuit ratings and to prevent the occurrence of inter-phasal faults exterior to the enclosure.

A still further purpose of the invention is to provide a compact circuit breaker having means for externally viewing the condition of the circuit breaker contacts.

An additional purpose of the invention is to allow the hot movable contact arm to impact against the bumper attached to the circuit breaker cover without melting the bumper.

A further additional purpose of the invention is to provide electrical isolation to the movable contact arm braid and to the current transformer pin connectors.

SUMMARY OF THE INVENTION

A compact industrial-rated circuit breaker includes a retractable operating handle extender for increasing the force required to open and close the circuit breaker contacts against the bias of the operating springs. A supplemental lug cover and exhaust gas dissipation compartment is attached to the line side of the circuit breaker to quench and de-ionize the exiting arc gases that occur under extreme overcurrent interruption. An anti-torquing feature on the line lug and load lug connectors allows the lug connectors to be torqued to high values without disturbing the positioning of the lugs within their respective lug compartments. Visual access slots are arranged through the circuit breaker cover to ascertain and verify the condition of the circuit breaker contacts. Thermal barriers are arranged on the movable contact arms and the movable contact arm bumpers to protect the movable contact arm bumpers from thermal damage. Electrical isolation is provided to the movable contact arm braid and to the current transformer pin connectors.

DESCRIPTION OF THE PREFERRED EMBODIMENT

Figure 1:
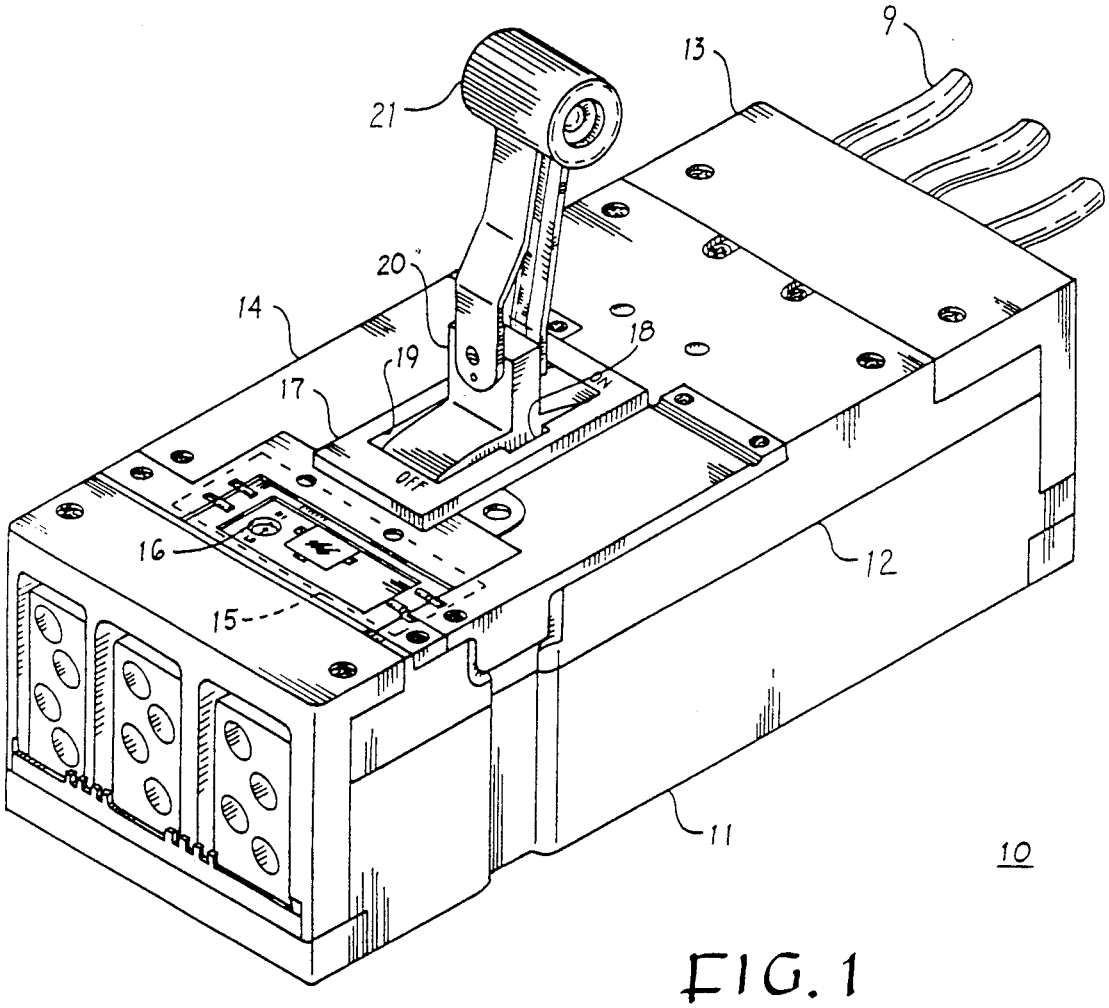
FIG. 1 is a front perspective view of the compact circuit breaker in accordance with the invention.

A compact circuit interrupter 10 is depicted in FIG. 1 and consists of a molded plastic case 11 to which a molded plastic cover 12 is securely fastened. An accessory cover 14 such as described within U.S. Pat. No. 4,754,247 is used to provide access to the various circuit breaker accessories that are completely field-installable. An electronic trip unit 15 is also arranged within the circuit breaker cover for providing overcurrent determination as well as electronic accessory function. One such electronic trip unit is described within U.S. Pat. No. 4,589,052. An externally accessible knob 16 is used for setting the circuit breaker trip parameters. The compact circuit breaker is capable of providing circuit interruption at increased ampere ratings by the provision of a novel lug cover-exhaust chamber 13 which is arranged on the line end of the breaker proximate the incoming power cables 9. An operating mechanism 33 (FIG. 3) is used to interrupt the circuit current by the bias provided by a pair of powerful operating springs such as described in U.S. patent application Ser. No. 330,521 filed Mar. 30, 1989. Due to the increased loading force applied to the operating mechanism by the operating springs, it is difficult to manually displace the circuit breaker operating handle 20 to turn the circuit breaker contacts between their closed and open positions as well as to reset the circuit breaker operating mechanism. To increase the force acting on the operating handle, a retractable handle extension 21 is fixedly attached to the operating handle which allows the operating handle to swing freely within the handle access slot 19 and provide sufficient force on the operating mechanism to reset and to close the circuit breaker contacts. A visual access slot 18 is arranged through the cover next to the cover escutcheon 17 to visually access and verify the position of the circuit breaker contacts in the manner to be described below in greater detail.

Figure 2:
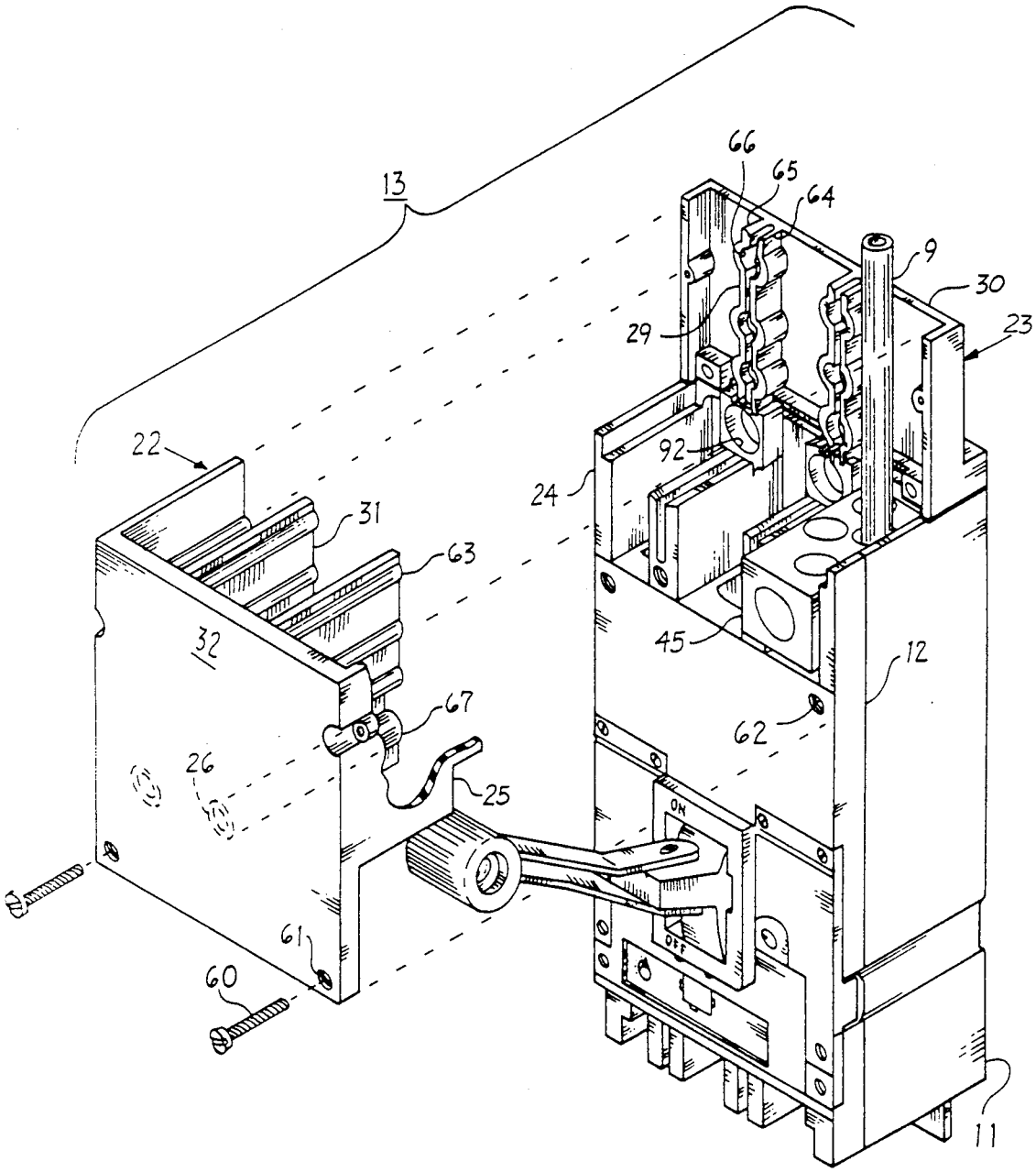
FIG. 2 is a top perspective view of the circuit breaker of FIG. 1 with the supplemental lug cover arc chamber in isometric projection.

The lug cover-exhaust chamber 13 hereafter "lug cover" is depicted in FIG. 2 prior to attachment to the compact circuit breaker 10. The lug cover consists of a top cover 22, that is removably attached to a base 23. The face plate 32 of the top cover includes a downwardly-facing extension 25 which is received within a shelf 24 formed on the circuit breaker cover 12 and is attached to the shelf by means of screws 60, thru-holes 61 and threaded openings 62 as indicated. A plurality of baffles 31 are integrally-formed with the cover 22 and a corresponding number of baffles 29 are integrally-formed with the base 23 to prevent the crossover of arc gases between the different phases fed by the incoming cables one of which is indicated at 9. The baffles 29 integrally-formed on the base 23 extend upright from the bottom 30 and support the upstanding rails 64, 65 within which radii 66 are formed which receive corresponding posts 63 integrally-formed within the baffles 31 on the cover 22. The posts and radii accurately position the baffles intermediate the incoming cables and line lugs 45 to prevent the exhaust gases from mixing between the various phases and causing an inter-phasal fault. A pair of knock-outs 26 on the face plate 32 cover the ends of a pair of tubes 67 integrally-formed with the baffles 31 and provide access to the thru-holes 92 formed on the circuit breaker case 11 for mounting the circuit breaker to an upstanding support wall. The knock-outs are removed and mounting bolts (not shown) are inserted within the tubes and the thru-holes to make the attachment.

Figure 3:
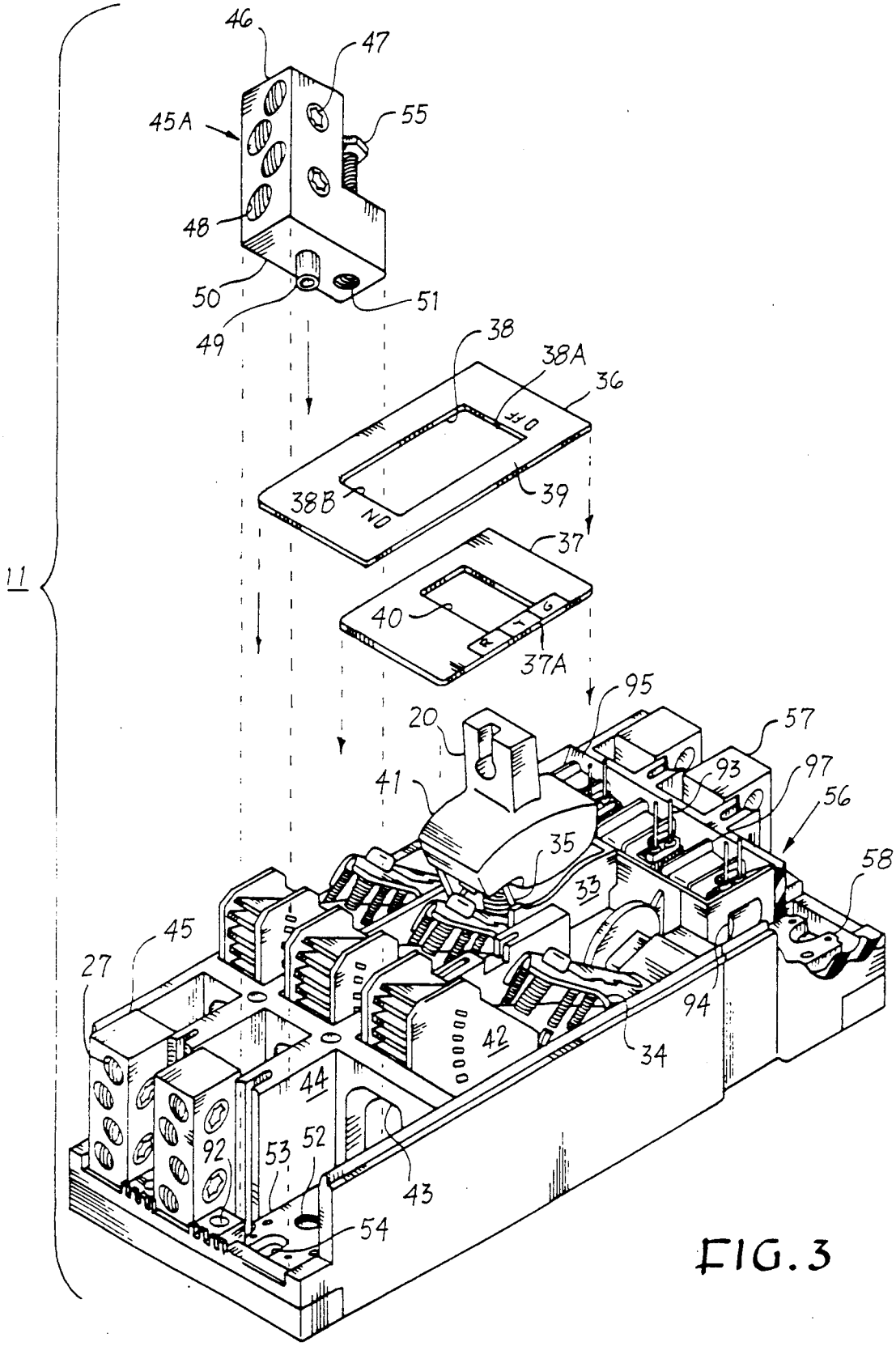
FIG. 3 is a top perspective view of the circuit breaker of FIG. 1 with the cover removed and with the anti-turn lug and operating handle shutters in isometric projection.

A circuit breaker case 11 is depicted in FIG. 3 with the cover removed to show the location of the operating mechanism 33 relative to the movable contact arms 34 and the arc chutes 42. The operating mechanism is similar to that described within aforementioned U.S. patent application Ser. No. 330,521. The operating mechanism is controlled by an electronic trip unit 15 shown earlier in FIG. 1 which receives input signals via transformers 94. As described within U.S. Pat. No. 4,907,342, transformer pin connector 93 connect with the trip unit by extending through the transformer cover 95 via openings 96. To hermetically seal the electronics within the trip unit from the intense arc gases that are generated within the case, silicone rubber gaskets 97 are arranged over the apertures. The transformer pin connectors pierce through the gaskets which become self-sealed by the resilience of the silicone rubber material. Manual intervention with the operating mechanism is made by means of a handle yoke 35 attached to the operating mechanism and by means of the upstanding operating handle 20 which defines a radially sloping shoulder 41. Three line lugs 45 are arranged within the line lug compartment 44 at one end of the case and corresponding load lugs 57 are arranged within the load lug compartment 56 at an opposite side of the case to accommodate connection within a multiphase power distribution circuit. The exhaust gases generated within the arc chutes 42 exit from the case through the apertures 43 formed within the case and become transported over the line straps 53 to the exterior of the circuit breaker. One such line lug 45A is depicted prior to insertion within the line lug compartment and includes an L-shaped body 46 through which attachment openings 47 are provided through the sides and similar openings 48 are arranged through the front surface thereof. A thru-hole 51 formed through the bottom 50 receives a screw 55 which threadedly engages a corresponding threaded aperture 52 formed within the line strap to secure the line lug thereto. To provide anti-turn function to the line lug, a stud 49 is formed on the bottom and is received within a corresponding slot 54 formed within the line strap. A corresponding slot 58 is formed on the load strap to accommodate a similar lug (not shown) on the bottom of the load lugs 57. This allows the electrical connection to be made via the openings 48 with the requisite torque applied to the line and load terminal screws 47 without fear of movement or loosening of the line and load lugs during the torquing process. The anti-turn function also prevents the line and load lugs from becoming loosened under severe short circuit overcurrent conditions. As described earlier, a pair of thru-holes 92 are formed within the bottom of the circuit breaker case to allow for attachment between the circuit breaker and an adjoining wall.

To ascertain the condition of the movable and fixed contacts 68, 69 (FIG. 4) by virtue of the position of the operating handle 20, a lost motion shutter 36, and an indicia shutter 37 are arranged over the operating handle shoulder 41 as shown in FIG. 3. The indicia handle shutter includes a narrow handle access slot 40 which fits over the operating handle 20 in a press-fit arrangement whereby the indicia handle shutter moves linearly in direct response to the movement of the operating handle. Colored indicia 37A are provided on the indicia handle shutter whereby the colors red, yellow, and green represent the "ON", "TRIPPED" and "OFF" states of the circuit breaker contacts. The lost motion handle shutter 36 contains an elongated rectangular slot 38 that operates "digitally" with respect to the motion of the operating handle, that is, the operating handle only contacts the edges 38A, 38B of the slot when the circuit breaker handles moves to its "OFF" and "ON" positions respectively. A narrow and elongated visual access slot 39 is positioned over the contact position indicia 37A to allow a viewer to see the indicia by means of the visual access slot 18 shown earlier in FIG. 1 which aligns with the visual access slot 39 and with the indicia.

Figure 4:
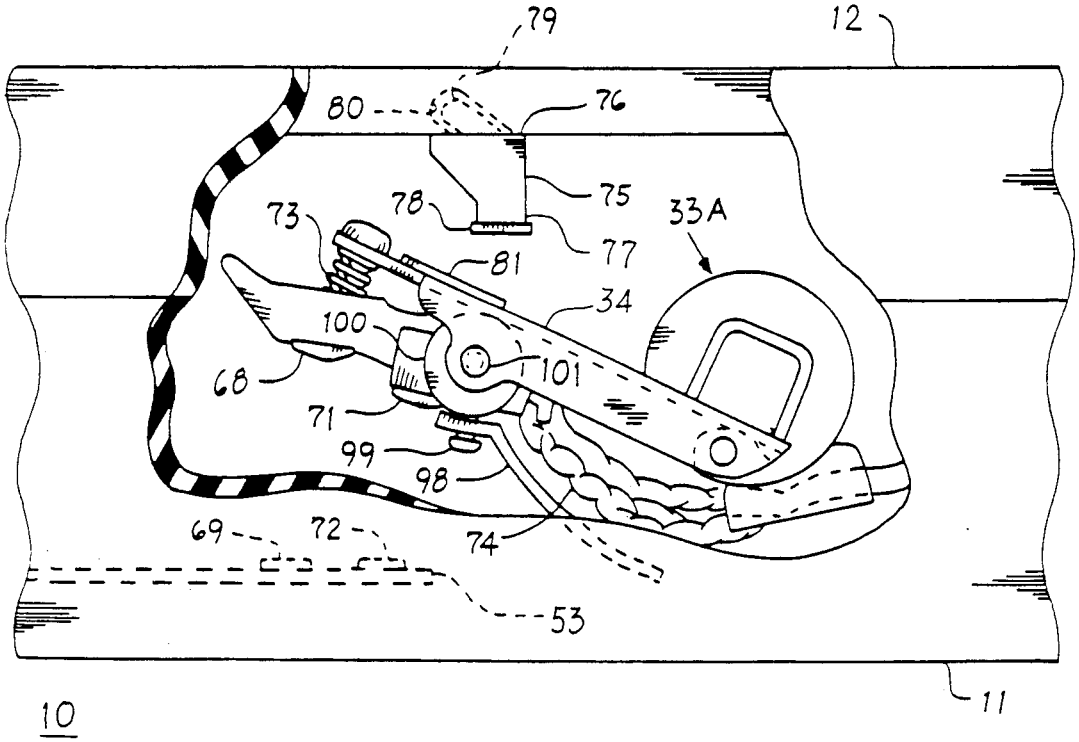
FIG. 4 is an enlarged side view of the circuit breaker of FIG. 1 with part of the cover and case removed to show the movable contact arm arrangement.

When the movable contact arm 34 and attached movable contact 68 and movable arcing contact 71 shown in FIG. 4 become electrodynamically separated from the corresponding fixed contact 69 and fixed arcing contact 72 arranged on the line strap 53, the movable contact 68 separates from the fixed contact 69 against the contact pressure provided by the contact spring 73 before the movable arcing contact 71 becomes separated from the corresponding fixed arcing contact 72 to ensure that the arc that occurs upon circuit interruption will be localized between the movable and fixed arcing contacts. The contact braid 74 ensures electrical connection with the movable contact arm 34. To protect the braid from electric circuit with the ionized gases that occur upon contact separation, a fiber shield 98 is arranged on the outside of the braid. The fiber shield is attached to a metal ring 100 by means of a rivet 99 and the metal ring is secured to the movable contact arm 34 by means of a pin 101. The operating mechanism later responds to open the movable contacts in the adjoining phases via the crossbar assembly 33A once the initial movable contact arm has responded by electrodynamic repulsion. As used within circuit breakers of the current limiting type whereby the movable contact arm moves independently of the operating mechanism by such electrodynamic repulsion, a bumper 75 of a rubber or plastic composition is used to absorb the impact against the circuit breaker cover 12 when the movable contact arm 34 is rapidly driven to its "blown open" position. The bumper is formed from a single piece of material and includes a wide base 76 at one end and a narrow top 77 at an opposite end. The bumper is secured to the circuit breaker cover by insertion of a post 79 integrally-formed within the bumper at an acute angle relative to the base 76, which post is inserted within a cavity 80 formed within the cover at the same acute angle. Under intense overcurrent conditions such as a short circuit, the short circuit current through the movable contact arm heats the movable contact arm up to a temperature in excess of several hundred Fahrenheit degrees which temperature is higher than the melting point temperature of the plastic or rubber material used to form the bumper 75. To prevent the hot movable contact arm from adhering to the bumper, a fiber plate 81 is attached to the movable contact arm while a corresponding fiber cap 78 is attached to the top 77 of the bumper. When the hot movable contact arm strikes against the bumper, the fiber plate 81, and fiber cap 77 thermally isolate the movable contact arm from the bumper and hence prevent sufficient transfer of heat to the bumper to cause the rubber or plastic material to melt.

Figure 5:
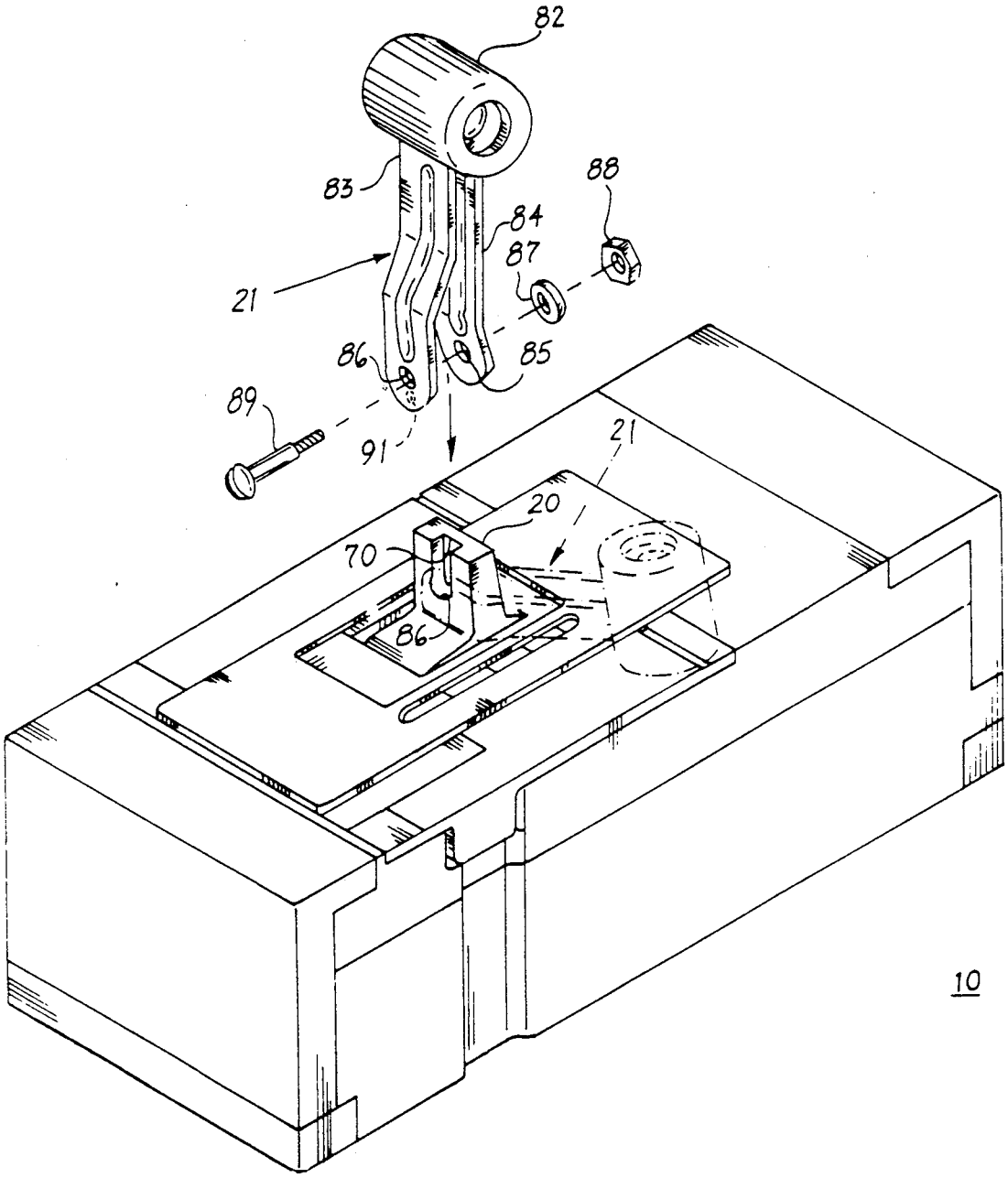
FIG. 5 is a top perspective view of the circuit breaker of FIG. 1 with the retractable handle extension in isometric projection.

Referring now to FIG. 5, the retractable handle extension 21 is shown prior to attachment to the operating handle 20. A thru-hole 86 is arranged through the handle, and a rectangular slot 70 is arranged vertically along the handle above the thru-hole. The handle extension basically consists of a pair of slotted and offset legs 83, 84 that are attached to a cylindrical handle 82 at one end and with a pair of thru-holes 85, 86 formed at an opposite end thereof. The handle extension is attached to the operating handle by means of the screw 89, thru-holes 85, 86, Belville washer 87 and nut 88. The spring-like Belville washer applies a bias to the offset legs such that the protrusion 91 formed on the inner side of the offset leg 83 interacts with the slot 70 to maintain the handle extension in the fully extended position indicated in FIG. 1 while, allowing the handle to rotate in the clockwise direction as viewed in FIG. 5 to the retracted clockwise position indicated in phantom or to a counterclockwise position, if preferred. This allows the handle extension to be retracted out of the way of the operator when not in use.

Having thus described our invention, what we claim as new and desire to secure by Letters Patent is:

1. A compact industrial-rated circuit breaker comprising:

a plastic circuit breaker case;

a plastic circuit cover attached to said case;

a pair of contacts arranged for automatic separation upon occurrence of an overcurrent condition through said contacts;

an operation handle extending through said cover allowing manual opening and closing of said contacts;

an arc chute proximate said contacts cooling and extinguishing an arc that occurs when said contacts become separated during said overcurrent conditions; and an extender attached to said operating handle providing additional force to said operating mechanism to facilitate said opening and closing of said contacts, said extender comprising a pair of opposing sidearms supporting an extender handle at one end, the opposite end of said sidearms being attached to said circuit breaker handle; and a slot on said circuit breaker handle and a protrusion on one of said sidearms, said protrusion becoming received within said slot when said extender is in a protracted position and said protrusion being out of said slot when said extender is in a retracted position.

2. The circuit breaker of claim 1 including an electronic trip circuit within said circuit breaker cover determining said overcurrent condition.

3. The circuit breaker of claim 1 wherein said sidearms are attached to said circuit breaker handle by means of a Belville washer to provide bias between said sidearms and said circuit breaker handle and thereby force said protrusion into said slot when said extender is in said protracted position.

4. The circuit breaker of claim 1 wherein said extender comprises a cylinder.

* * * * *